US009739019B1

(12) United States Patent
Godbersen

(10) Patent No.: US 9,739,019 B1
(45) Date of Patent: Aug. 22, 2017

(54) BRIDGE PAVING DEVICE

(71) Applicant: GOMACO Corporation, Ida Grove, IA (US)

(72) Inventor: Gary L. Godbersen, Ida Grove, IA (US)

(73) Assignee: GOMACO Corporation, Ida Grove, IA (US)

( * ) Notice: Subject to any disclaimer, the term of this patent is extended or adjusted under 35 U.S.C. 154(b) by 77 days.

(21) Appl. No.: 14/739,493

(22) Filed: Jun. 15, 2015

Related U.S. Application Data

(60) Provisional application No. 62/011,687, filed on Jun. 13, 2014.

(51) Int. Cl.

| | |
|---|---|
| ***E01C 19/22*** | (2006.01) |
| ***E01C 19/00*** | (2006.01) |
| ***E01C 7/00*** | (2006.01) |
| ***E01C 19/48*** | (2006.01) |
| ***E01C 19/50*** | (2006.01) |
| ***E01C 9/00*** | (2006.01) |
| ***E01D 19/12*** | (2006.01) |
| ***E01D 21/00*** | (2006.01) |

(52) U.S. Cl.
CPC ..... *E01C 19/004* (2013.01); *E01C 7/00* (2013.01); *E01C 9/001* (2013.01); *E01C 19/22* (2013.01); *E01C 19/4886* (2013.01); *E01C 19/502* (2013.01); *E01D 19/125* (2013.01); *E01D 21/00* (2013.01)

(58) Field of Classification Search
CPC ..... E01C 7/00; E01C 9/001; E01C 19/004; E01C 19/4886; E01C 19/502; E01C 19/22; E01D 19/125; E01D 21/00
USPC ..... 404/84.05–84.5, 106
See application file for complete search history.

(56) References Cited

U.S. PATENT DOCUMENTS

| | | | | |
|---|---|---|---|---|
| 6,074,693 | A * | 6/2000 | Manning | B05B 12/12 118/697 |
| 2006/0198700 | A1* | 9/2006 | Maier | E01C 19/006 404/84.1 |
| 2007/0025815 | A1* | 2/2007 | Sick | E01C 19/004 404/84.1 |
| 2007/0059098 | A1* | 3/2007 | Mayfield | A63C 19/06 404/84.5 |
| 2010/0215433 | A1* | 8/2010 | Fritz | E01C 19/006 404/84.5 |
| 2010/0266339 | A1* | 10/2010 | Guntert, Jr. | E01C 19/42 404/105 |

(Continued)

*Primary Examiner* — Raymond W Addie
(74) *Attorney, Agent, or Firm* — Suiter Swantz pc llo

(57) ABSTRACT

A bridge paving device includes one or more reference receivers to locate the bridge paving device in three-dimensional space. A computer apparatus receives the location of the bridge paving device and associates the location with a bridge paving design profile. The computer apparatus independently actuates a system of hydraulic actuators of the bridge paving device to level and orient the bridge paving device regardless of the travel surface the linear movement elements are running on. Additional hydraulic actuators may adjust the shape of the bridge paving device over time as the bridge paving device travels a linear distance of the bridge to be paved. The shape adjustment alters a crown or inversion applied to the bridge such that run-off characteristics are more variable and controllable along the entire span of the bridge.

18 Claims, 6 Drawing Sheets

(56) References Cited

U.S. PATENT DOCUMENTS

| | | | | |
|---|---|---|---|---|
| 2012/0288328 | A1* | 11/2012 | Minich | E01C 19/1063<br>404/72 |
| 2014/0133906 | A1* | 5/2014 | Frelich | E01C 19/00<br>404/75 |
| 2016/0054283 | A1* | 2/2016 | Stromsoe | E02D 1/02<br>73/488 |
| 2016/0177517 | A1* | 6/2016 | Engels | G06T 7/20<br>404/75 |
| 2016/0305075 | A1* | 10/2016 | Thieme | E01C 19/004 |

* cited by examiner

BRIDGE PAVING DEVICE

PRIORITY

The present application claims the benefit under 35 U.S.C. §119(e) of U.S. Provisional Application Ser. No. 62/011,687, filed Jun. 13, 2014, which is incorporated herein by reference.

FIELD OF THE INVENTION

The present invention is directed generally toward paving machines, and more particularly toward paving machines having cylinder finishers.

BACKGROUND OF THE INVENTION

Bridge paving is one of the most technical and labor intensive paving applications. Typically, once the structure of a bridge is in place, guide elements are placed along the periphery of the area to be paved. The guide elements define a reference, and possibly a useable surface, for the linear movement elements of a paving machine.

Because the guide elements define a reference from which all paving operations will be measured, the guide elements must be positioned very precisely. Often, paving crews spend weeks or months surveying and confirming the location of each guide element to ensure that the resulting reference conforms to a design profile for the bridge.

Once all guide elements are in position, the paving machine is sent through a test run to ensure the paving machine can traverse the guide elements. Then an actual paving operation is performed.

The entire process can take several months, but the actual paving operation can be performed in a single day. Consequently, it would be advantageous if an apparatus existed that is suitable for allowing a bridge paving machine to pave a bridge more efficiently and with less preparation than the prior art.

SUMMARY OF THE INVENTION

Accordingly, the present invention is directed to a novel method and apparatus for allowing a bridge paving machine to pave a bridge more efficiently and with less preparation than the prior art.

In one embodiment, a bridge paving device includes one or more reference prisms to locate the bridge paving device in three-dimensional space. A computer apparatus receives the location of the bridge paving device and associates the location with a bridge paving design profile. The computer apparatus independently actuates a system of hydraulic actuators corresponding to the linear movement elements of the bridge paving device to level and orient the bridge paving device regardless of the travel surface the linear movement elements are running on. Furthermore, one or more powered transition adjusters may adjust the frame shape of the bridge paving device over time as the bridge paving device travels a linear distance of the bridge to be paved. The varying frame shape may alter the crown applied to the bridge such that run-off characteristics are more variable and controllable along the entire span of the bridge.

In another embodiment, the bridge paving device includes one or more satellite receivers for receiving a positioning signal to locate the bridge paving device in three dimensional space.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
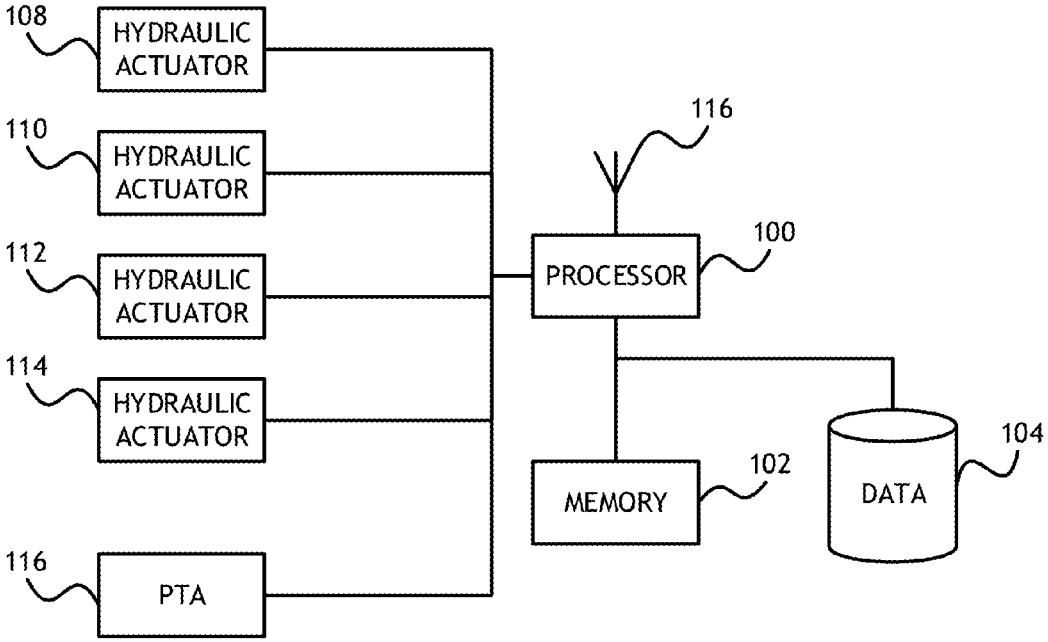
FIG. 1 shows a block diagram of a computer apparatus according to one embodiment of the present invention.

Referring to FIG. 1, a block diagram of a computer apparatus according to one embodiment of the present invention is shown. In at least one embodiment, a bridge paving device includes a processor 100, memory 102 connected to the processor 100 for storing computer executable program code and a data storage element 104 configured to store a bridge paving profile.

The processor 100 may also be connected to an antenna 106. The antenna 106 may be configured to receive location data from a surveying instrument such as a Total Station. Alternatively, or in addition, the antenna 106 may receive a satellite based location signal such as a GPS signal for determining the location of the Bridge paving device. Furthermore, a second antenna 106 may also be connected to the processor 100; the second antenna 106 may receive a second satellite based location signal such that the known difference in location between the first antenna 106 and the second antenna 106 may be used to determine an orientation of the bridge paving device. Alternatively, or in addition, the processor 100 may receive orientation information through the antenna 106 from a separate surveying instrument.

The processor 100 may correlate the location and orientation information to the bridge paving profile. The processor 100 thereby knows the location and orientation of the bridge paving device as it pertains to a desired location and orientation defined in the bridge paving profile. The processor 100 may actuate one or more hydraulic actuators 108, 110, 112, 114, for example through a hydraulic control system, to adjust the position and orientation of the bridge paving device to conform to parameters defined by the bridge paving profile.

The processor 100 may receive updated location and orientation information through the antenna 106, and periodically correlate the updated location and orientation information to the bridge paving profile. The processor 100 continuously adjusts the hydraulic actuators 108, 110, 112, 114 to maintain the bridge paving device within the defined parameters as the bridge paving device moves linearly along the surface being paved.

Furthermore, the processor 100 may be connected to one or more powered transition adjusters 116 connected to portions of the bridge paving device. In at least one embodiment, the powered transition adjusters 116 are configured to adjust the shape of the main support structure of the bridge paving device to create or adjust a crown or inversion in the paved surface. Alternatively, the height of a bridge paving carriage may vary along both the width of the paved surface and the length of the bridge span as defined by the bridge paving profile according to desired run-off parameters.

Figure 2:
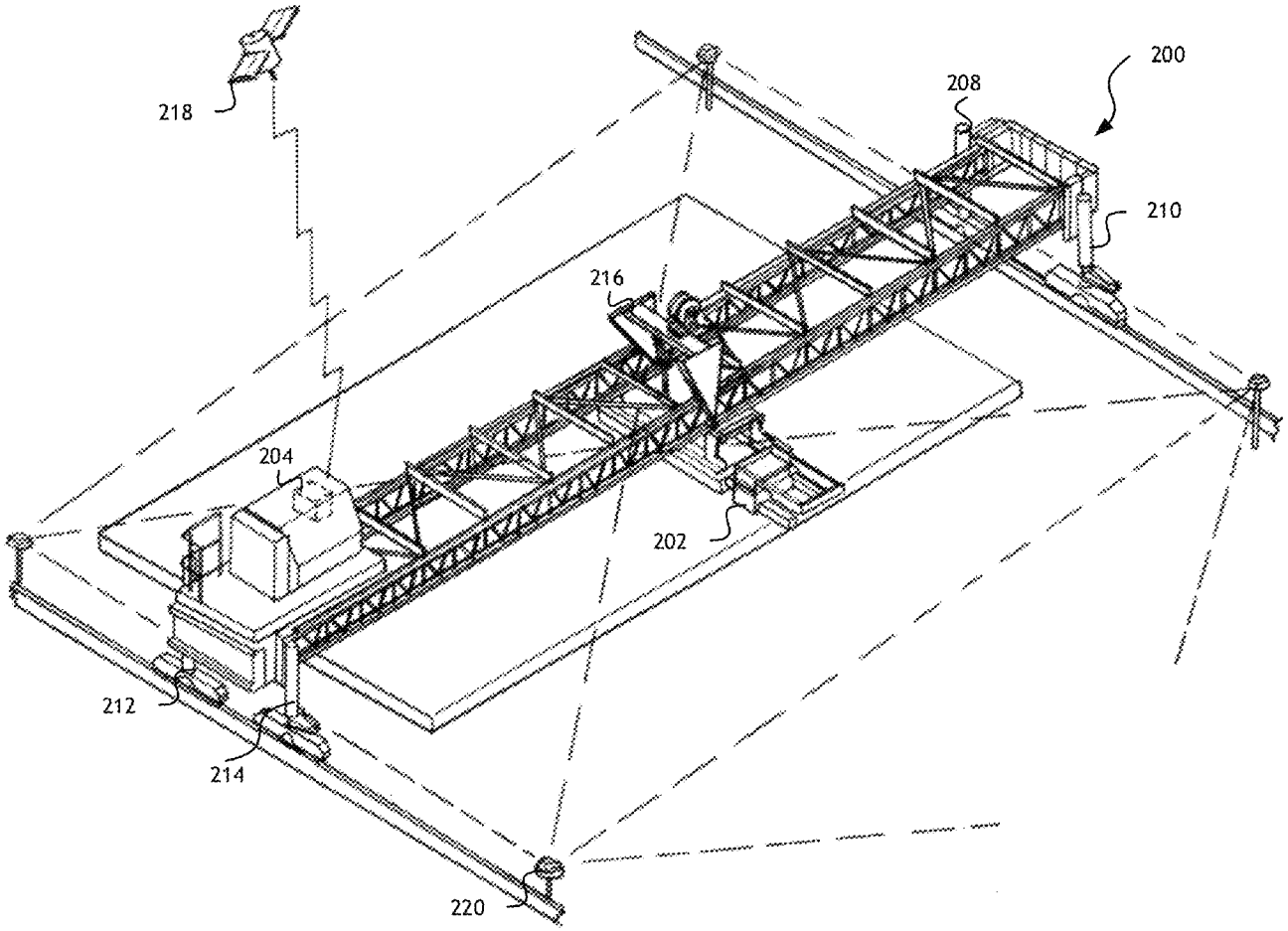
FIG. 2 shows a perspective environmental view of a bridge paving device according to one embodiment of the present invention.

Referring to FIG. 2, a perspective environmental view of a bridge paving device according to one embodiment of the present invention is shown. In at least one embodiment, a bridge paving device 200 includes a power and control unit 204 configured to power and control hydraulic actuators 208, 210, 212, 214 associate with the linear movement elements that move the bridge paving device linearly along a bridge structure to be paved. Linear movement elements may include tracks, wheels, bogies or any other suitable device for producing linear movement in the bridge paving device. The power and control unit 204 also controls the motion of a paving carriage 202 which may comprise a cylinder finisher and in at least one embodiment, one or more powered transition adjusters 216 configured to adjust the shape of the main support structure. Different shapes of the main support structure may alter the shape of a crown or inversion in the paved surface. Furthermore, different shapes of the main support structure coupled with adjustments to the paving carriage 202 may allow the power and control unit 204 to apply continuous, variable slopes to the paved surface.

The power and control unit 204 may also include an antenna configured to receive location data from a surveying instrument such as a Total Station 220. Alternatively, or in addition, the power and control unit 204 may receive a satellite 218 based location signal such as a GPS signal for determining the location of the Bridge paving device 200. The bridge paving device 200 may be equipped with reference features such as surveying prisms, or GPS receivers or both, sufficient to locate and orient the bridge paving device 200 with reference to a bridge paving profile.

The power and control unit 204 may actuate one or more hydraulic actuators 208, 210, 212, 214 associated with the linear movement elements that drive the bridge paving device 200 to adjust the position and orientation of the bridge paving device 200 to conform to parameters defined by the bridge paving profile.

The power and control unit 204 may receive updated location and orientation information and periodically correlate the updated location and orientation information to the bridge paving profile. The power and control unit 204 continuously adjusts the hydraulic actuators 208, 210, 212, 214 to maintain the bridge paving device 200 within the defined parameters as the bridge paving device 200 moves linearly along the surface being paved.

In at least one embodiment, a bridge paving device 200 may be configured to distribute the load of the bridge paving device 200 on the bridge structure by directing the linear movement elements on one side of the bridge paving device 200 to maintain a relative position further along the bridge with reference to the linear movement elements on the other side. The bridge paving device 200 is thereby skewed in the direction of linear travel. Where a bridge paving profile includes complex crown or inversion features, such complexity is significantly increased where the bridge paving device 200 is skewed. Such complexity may require the power and control unit 204 to maintain intricate control and interrelation of the paving carriage 202 movement and powered transition adjuster 216.

Figure 3:
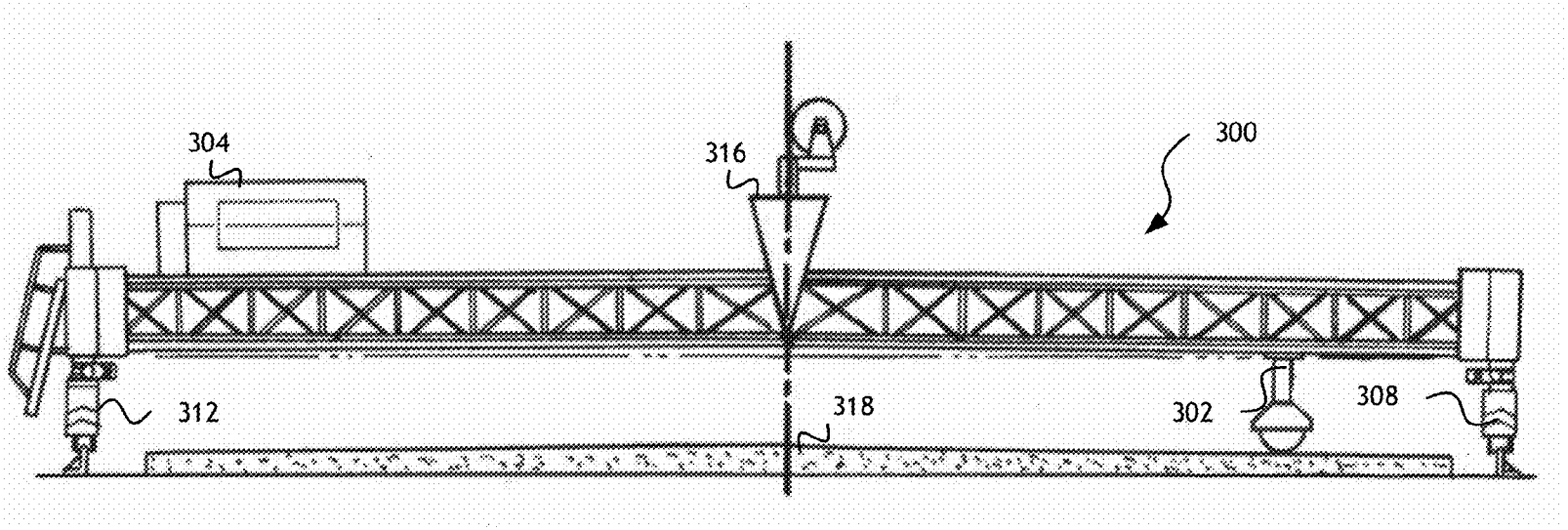
FIG. 3 shows a front environmental view of a bridge paving device according to an embodiment of the present invention.

Referring to FIG. 3, a front environmental view of a bridge paving device according to the present invention is shown. In at least one embodiment, a bridge paving device 300 includes a power and control unit 304 configured to power and control hydraulic actuators 308, 312, associate with the linear movement elements that move the bridge paving device linearly along a bridge structure to be paved, the motion of a paving carriage 302 and in at least one embodiment, one or more powered transition adjusters 316 configured to apply a crown 318 to a surface being paved.

The power and control unit 304 may include an antenna configured to receive location data from a surveying instrument or a satellite based location signal for determining the location of the bridge paving device 300 with reference to a bridge paving profile. The bridge paving profile may include a crown 318 or inversion that may vary along the length of the bridge span.

The powered transition adjusters 316 may alter the shape in the main support structure of the bridge paving device 300 to create or adjust a crown 318 or inversion in the paved surface. Alternatively, a paving carriage 302 may be raised and lowered according to the bridge paving profile. The height of the bridge paving carriage 302, including a cylinder finisher, may vary along both the width of the paved surface and the length of the bridge span as defined by the bridge paving profile according to desired run-off parameters.

Figure 4:
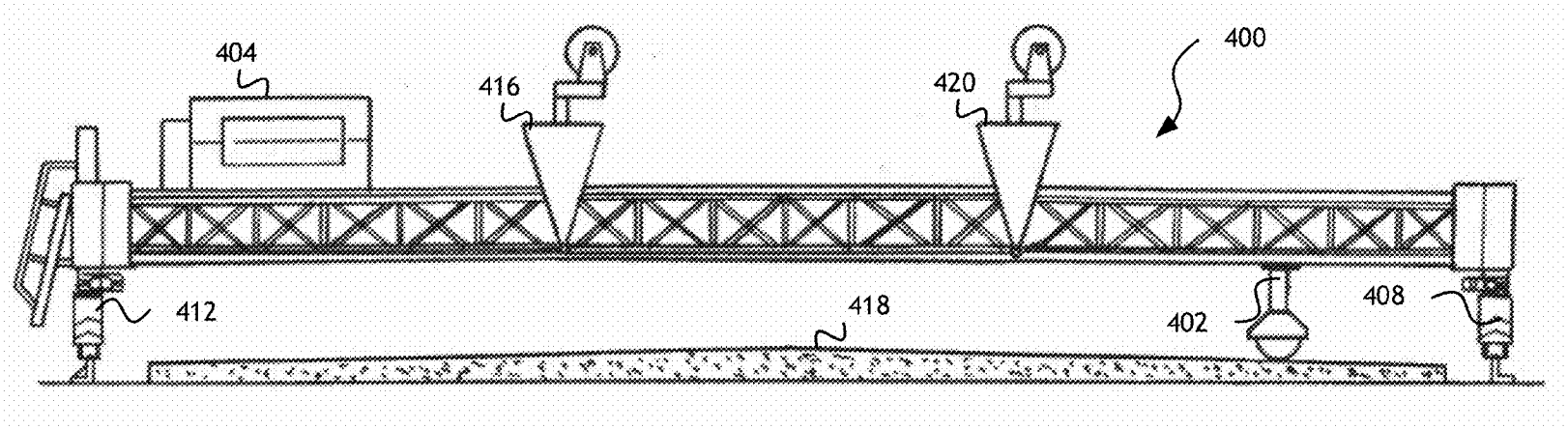
FIG. 4 shows a front environmental view of a bridge paving device according to another embodiment of the present invention.

Referring to FIG. 4, a front environmental view of a bridge paving device according to another embodiment of the present invention is shown. In at least one embodiment, a bridge paving device 400 includes a power and control unit 404 configured to power and control hydraulic actuators 408, 410, 412, 414 associate with the linear movement elements that move the bridge paving device linearly along a bridge structure to be paved. The power and control unit 404 also controls the motion of a paving carriage 402 which may comprise a cylinder finisher and in at least one embodiment, one or more powered transition adjusters 416, 420 configured to change the shape of the main support structure of the bridge paving device 400. Different shapes of the main support structure may alter the shape of a crown or inversion in the paved surface. Also, where a first powered transition adjuster 416 is configured to alter the shape of a first portion of the main support structure and a second powered transition adjuster 420 is configured to alter the shape of a second position of the main support structure, the power and control element 404 may induce a disparity of shapes in the main support structure to produce a desired frame shape and thereby a desired paved surface slope. Furthermore, different shapes of the main support structure coupled with adjustments to the paving carriage 402 may allow the power and control unit 404 to apply continuous, variable slopes to the paved surface.

While FIG. 4 shows a bridge paving device 400 with two powered transition adjusters 416, 420, more than two powered transition adjusters 416, 420 are contemplated. More than two powered transition adjusters 416, 420 may be useful for producing a paved surface having a complex design profile. Complex design profiles may include multiple crowns or inversions to achieve desired drainage characteristics, banked portions, or any other features that require shape alterations to the main support structure that are unachievable with two powered transition adjusters 416, 420.

Figure 5:
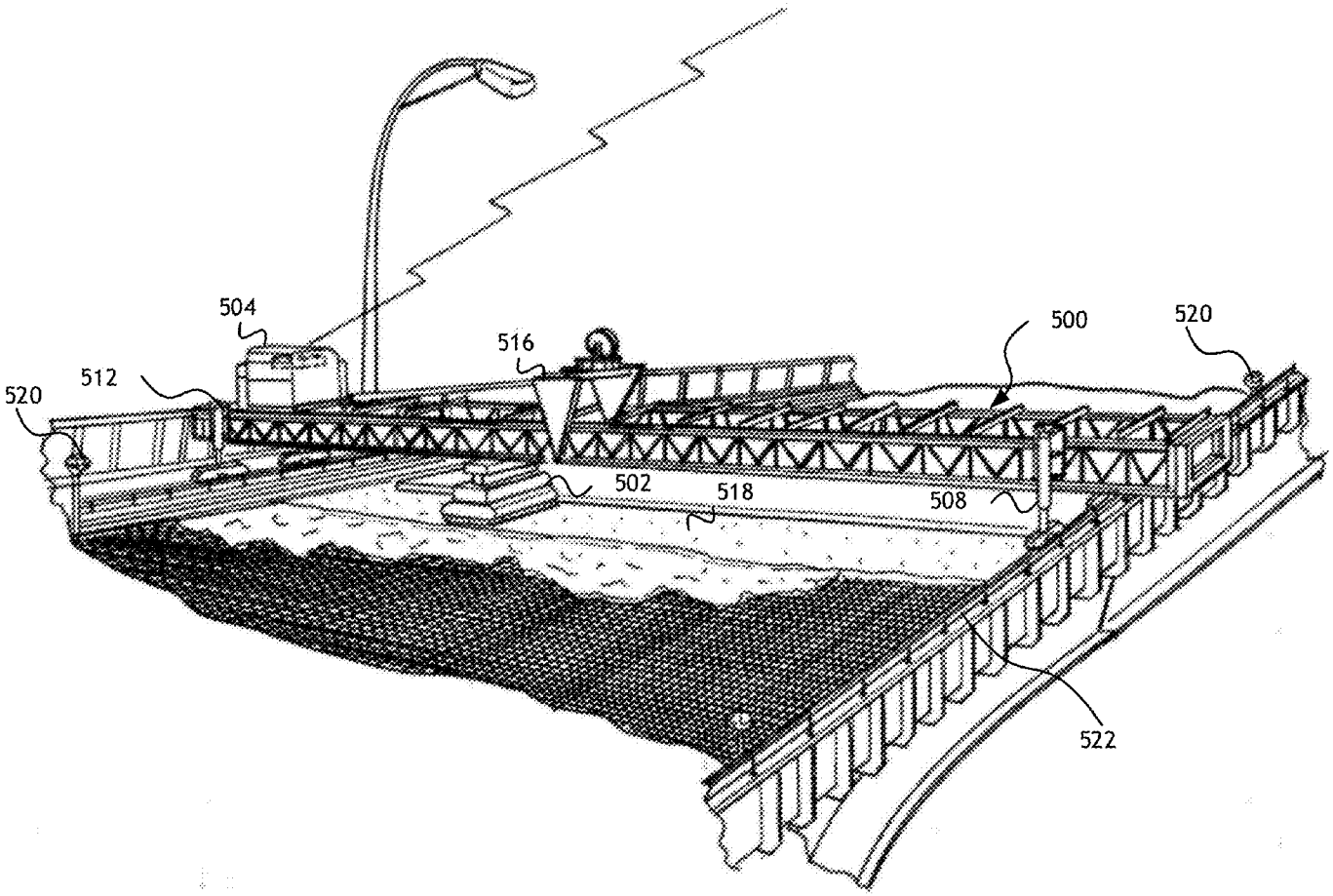
FIG. 5 shows another environmental view of a bridge paving device according to the present invention.

Referring to FIG. 5, another environmental view of a bridge paving device according to the present invention is shown. In at least one embodiment, a bridge paving device 500 includes a power and control unit 504 configured to power and control hydraulic actuators 508, 512 associate with the linear movement elements that move the bridge paving device linearly along a bridge structure to be paved 518, the motion of a paving carriage 502 including a cylinder finisher and in at least one embodiment, one or more powered transition adjusters 516 configured to adjust the shape of the main support structure according to a desired paving profile to apply a crown or inversion to the surface being paved 518.

The power and control unit 504 may also include an antenna configured to receive location data from a surveying instrument such as a Total Station 520. Alternatively, or in addition, the power and control unit 504 may receive a satellite based location signal such as a GPS signal for determining the location of the Bridge paving device 500. The bridge paving device 500 may be equipped with reference features such as surveying prisms, or GPS receivers or both, sufficient to locate and orient the bridge paving device 500 with reference to a bridge paving profile.

The linear movement elements that move the bridge paving device 500 linearly along the bridge structure to be paved 518 may run on guide elements 522 positioned according to the paving profile during construction of the bridge structure to be paved. In at least one embodiment, the tolerances for the location of the guide elements 522 are significantly less rigid as compared to the prior art.

Figure 6:
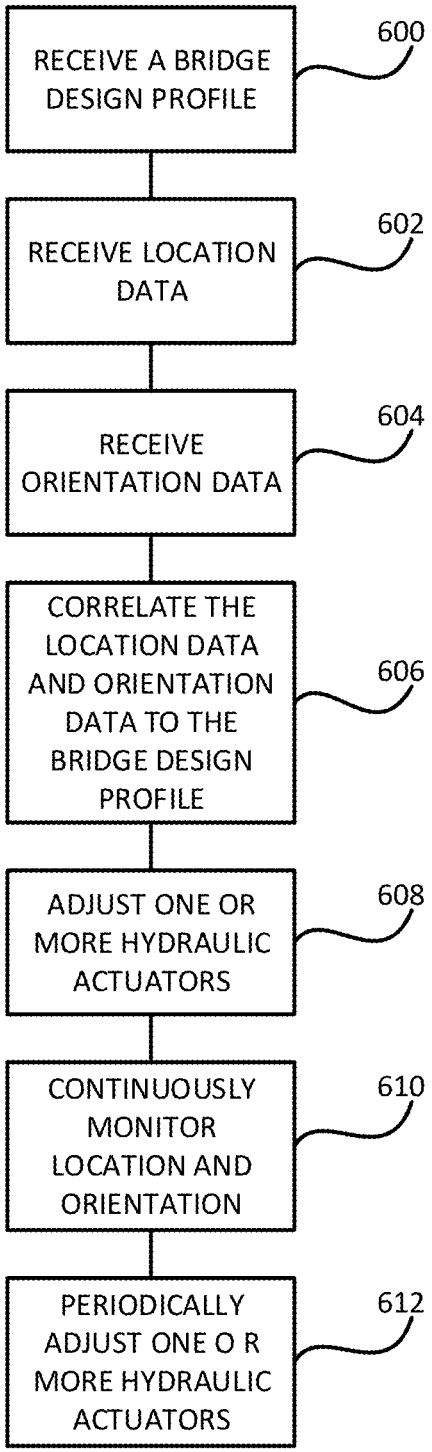
FIG. 6 shows a flowchart of a method for controlling a bridge paving device according to one embodiment of the present invention.

Referring to FIG. 6, a flowchart of a method for controlling a bridge paving device according to one embodiment of the present invention is shown. In at least one embodiment, a bridge paving device receives 600 a bridge design profile that defines the necessary location of the bridge paving device, and in at least one embodiment, a variable crown or inversion to be applied to the paved surface. The bridge paving device also receives 602 location data corresponding to the position of the bridge paving device and orientation data 604 corresponding to the orientation of the bridge paving device.

The bridge paving device correlates 606 the location and orientation data to the bridge design profile and adjusts 608 one or more hydraulic actuators to bring the location and orientation of the bridge paving device in line with the parameters of the bridge design profile. During paving, the bridge paving device continuously monitors 610 the location and orientation of the bridge paving device, either through continuously receiving updated data or adjusting the known location and orientation based on operations executed by the bridge paving device or both. Based on the updated location and orientation data, and the parameters of the bridge design profile, the bridge paving device may periodically adjust 612 one or more hydraulic actuators or one or more powered transition adjusters or both simultaneously.

A person skilled in the art may appreciate that while the exemplary embodiments disclosed herein describe hydraulic actuators, additional embodiments are envisioned. For example, linear mechanical actuators, screw jacks or other substantially equivalent mechanisms are contemplated.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A bridge paving apparatus comprising:
- a processor;
- an antenna connected to the processor;
- an hydraulic control system connected to the processor;
- a plurality of linear movement element hydraulic actuators connected to the hydraulic control system;
- a main support structure connecting the plurality of linear movement element hydraulic actuators; and
- a first powered transition adjuster connected to the main support structure and the processor, the first powered transition adjuster configured to adjust a shape of the main support structure such that the main support structure conforms to a shape of a crown or inversion,
- wherein the processor is configured to:
  - receive location and orientation information;
  - correlate the location and orientation information with reference to a bridge design profile;
  - actuate one or more of the plurality of linear movement element hydraulic actuators to alter a position and orientation of the bridge paving device to conform to the bridge design profile;
  - continuously update the position and orientation information; and
  - continuously adjust one or more of the plurality of linear movement element hydraulic actuators to maintain the position and orientation of the bridge paving device within a range defined by the bridge design profile.

2. The bridge paving apparatus of claim 1, wherein the processor is further configured to continuously adjust the first powered transition adjuster to apply a crown or inversion to a paving surface.

3. The bridge paving apparatus of claim 2, wherein the bridge design profile comprises a variable crown or inversion correlated to various locations in the bridge design profile.

4. The bridge paving apparatus of claim 1, further comprising one or more additional powered transition adjusters connected to the main support structure and the processor, wherein the first powered transition adjuster is configured to adjust a shape of a first portion of the main support structure and the one or more additional powered transition adjusters are configured to adjust a shape of one or more additional portions of the main support structure to conform to multiple crowns or inversions.

5. The bridge paving apparatus of claim 1, further comprising a paving carriage connected to the processor, wherein the processor is configured to adjust a paving cylinder elevation relative to a paving surface.

6. The bridge paving apparatus of claim 5, wherein the bridge design profile comprises a variable crown or inversion correlated to various locations in the bridge design profile.

7. A construction apparatus comprising:

a main support structure;

a processor;

an antenna connected to the processor;

a first powered transition adjuster connected to the main support structure and the processor, the first powered transition adjuster configured to adjust a shape of the main support structure to conform to a desired crown or inversion;

a paving carriage connected to the processor, configured to transit along the main support structure and apply the crown or inversion to a paving surface according to the shape of the main support structure as defined by the powered transition adjuster;

an hydraulic control system connected to the processor; and a plurality of linear movement element hydraulic actuators connected to the main support structure and the hydraulic control system, wherein the processor is configured to:

receive location and orientation information;

correlate the location and orientation information with reference to a bridge design profile;

actuate one or more of the plurality of linear movement element hydraulic actuators to alter a position and orientation of the bridge paving device to conform to the bridge design profile;

continuously update the position and orientation information; and continuously adjust one or more of the plurality of linear movement element hydraulic actuators to maintain the position and orientation of the bridge paving device within a range defined by the bridge design profile.

8. The construction apparatus of claim 7, wherein the processor is further configured to continuously adjust the first powered transition adjuster to apply a crown or inversion to a paving surface.

9. The construction apparatus of claim 8, wherein the bridge design profile comprises a variable crown or inversion correlated to various locations in the bridge design profile.

10. The construction apparatus of claim 9, further comprising one or more additional powered transition adjusters connected to the main support structure and the processor, wherein the first powered transition adjuster is configured to adjust a shape of a first portion of the main support structure and the one or more additional powered transition adjusters are configured to adjust a shape of one or more additional portions of the main support structure to conform to multiple crowns or inversions.

11. The construction apparatus of claim 7, wherein the bridge design profile comprises a variable crown or inversion correlated to various locations in the bridge design profile.

12. The construction apparatus of claim 7, further comprising one or more Total Station prisms configured to locate the construction apparatus with relation to the bridge design profile.

13. A method for paving a bridge comprising:

receiving location and orientation information;

correlating the location and orientation information with reference to a bridge design profile;

actuating one or more of a plurality of linear movement element hydraulic actuators to alter a position and orientation of a bridge paving device to conform to the bridge design profile;

continuously updating the position and orientation information;

continuously adjusting one or more of the plurality of linear movement element hydraulic actuators to maintain the position and orientation of the bridge paving device within a range defined by the bridge design profile; and adjusting a shape of a main support structure with a first powered transition adjuster such that the main support structure conforms to a shape of a crown or inversion.

14. The method of claim 13, further comprising continuously adjusting the first powered transition adjuster to apply the crown or inversion to a paving surface.

15. The method of claim 14, wherein the bridge design profile comprises a variable crown or inversion correlated to various locations in the bridge design profile.

16. The method of claim 13, further comprising adjusting the shape of the main support structure with the first powered transition adjuster and one or more additional powered transition adjusters.

17. The method of claim 13, further comprising applying the crown or inversion to a paving surface by raising and lowering a paving carriage.

18. The method of claim 17, wherein the bridge design profile comprises a variable crown or inversion correlated to various locations in the bridge design profile.

* * * * *